US005687451A

United States Patent [19]

Singer

[11] Patent Number: 5,687,451

[45] Date of Patent: Nov. 18, 1997

[54] REVOLVING DOOR DEVICE

[75] Inventor: Lothar Singer, Heimsheim, Germany

[73] Assignee: Geze GmbH & Co., Leonberg, Germany

[21] Appl. No.: 591,495

[22] PCT Filed: Jul. 10, 1994

[86] PCT No.: PCT/EP94/02257

§ 371 Date: Apr. 8, 1996

§ 102(e) Date: Apr. 8, 1996

[87] PCT Pub. No.: WO95/02107

PCT Pub. Date: Jan. 19, 1995

[30] Foreign Application Priority Data

Jul. 10, 1993 [DE] Germany ..... 43 23 150.0

[51] Int. Cl.[6] ..... E05F 1/00

[52] U.S. Cl. ..... 16/71; 16/58

[58] Field of Search ..... 16/71, 79, 58, 16/51, 62, 69, DIG. 9, DIG. 10; 49/30, 334–336, 340–342

[56] References Cited

U.S. PATENT DOCUMENTS 4,365,442 12/1982 Speer ..... 49/30

4,660,250 4/1987 Tillman et al. ..... 16/58

4,910,961 3/1990 Ribaudo ..... 60/476

4,995,194 2/1991 Schultze et al. ..... 49/32

5,251,400 10/1993 Schultze ..... 16/58

*Primary Examiner*—Chuck Y. Mah

*Attorney, Agent, or Firm*—Evenson McKeown Edwards & Lenahan, PLLC

[57] ABSTRACT

An automatic revolving door drive is described, with a hydraulic piston-cylinder unit with a closing spring and an opener motor, consisting of an electric motor and hydraulic pump. It is a so-called servo closer, with which the door is opened with motor support and automatically closes with hydraulic damping under the influence of the closing spring.

In order to be able to use even low-powered opener motors and to produce a relatively compact design, provision is made such that during the motorized opening process the pressure of the hydraulic medium is regulated with adjustment to the prevailing force of the closing spring, in which the closing spring that cooperates with the piston abuts the piston at one end and a hydraulic pressure cushion at the other end, with the same hydraulic pressure being set and regulated by a special pressure-regulating valve in the pressure chamber and in the hydraulic pressure cushion.

23 Claims, 5 Drawing Sheets

REVOLVING DOOR DEVICE

BACKGROUND AND SUMMARY OF THE INVENTION

The invention relates to a revolving door drive having a hydraulic closing device with a hydraulic piston-cylinder unit, a closing spring and a motor-operated opening device with a hydraulic pump and an electromotor.

A revolving door drive of this type is known, for example, from German Patent Document DE-OS 32 02 966. A so-called electrohydraulic door closing device is described there which has a pressure spring as an energy accumulator for the closing and a hydraulic pump with an electromotor for the motor-operated opening. The opening of the door takes place fully automatically in that the piston is hydraulically displaced by means of the hydraulic pump while the closing spring is compressed; the closing operation will then take place purely mechanically as in the case of a conventional hydraulic door closing device under the effect of the closing spring. It is a disadvantage in the case of such known revolving door drives with a fully automatic opener motor that the construction is relatively large. It is essentially the result of the high-power unit consisting of the hydraulic pump and the electromotor which is required for the fully automatic opening. However, in practice, a fully automatic motor-operated opening of the door is frequently not necessary. A so-called servo-closer would often be sufficient which has an opening motor which is used only for the purpose of assisting in the case of a manual opening.

From German Patent Document DE-OS 32 34 319, a so-called automatic door closing device is known in the case of which the closing spring can be prestressed hydraulically during the opening by way of an independently movable supporting member arranged between the piston and the closing spring by means of a hydraulic pump so that the user of the door does not have to apply any force for the prestressing of the closing spring. The construction is relatively complicated.

It is an object of the invention to further develop an initially mentioned revolving door drive in such a manner that it can be used as a servo door closer and has a relatively simple and small construction.

The invention achieves this object in that, during the motor-operated opening operation, the pressure of the hydraulic medium is controlled while it is adapted to the momentary force of the closing spring. As a result, it is taken into account that, as a function of the respective door opening angle and depending on the spring prestressing, different pump pressures are in each case required in order to manually open the door, preferably along the whole rotating range without any additional application of force.

In preferred embodiments of the revolving door drive, the piston is displaceably guided in the hydraulic cylinder while forming a pressurized chamber and an unpressurized chamber. For controlling the pump pressure, it may be provided in this case that the closing spring interacting with the piston or a spring adapted to this closing spring is supported by means of its one end on the piston and by means of its other end on a hydraulic pressure pad, in which case the same hydraulic pressure is adjusted in a controlled manner in the pressure chamber and in the hydraulic pressure pad. Preferably, the pressure chamber and the hydraulic pressure pad are hydraulically connected in this case with the delivery side of the hydraulic pump and, in different opening positions of the door, a pressure equilibrium can be adjusted in the pressure chamber and in the pressure pad. According to the relationship of the operative surfaces of the piston absorbing the pressure in the pressure chamber and of the valve member in the pressure pad, when the pressure equilibrium is adjusted, the piston is displaced under the effect of the pump pressure (automatic opening system) or is held in a floating manner (servo operation). In preferred embodiments, the quotient of the operative surfaces can be adjusted in an optional manner.

In the stationary pressure equilibrium in the servo operation, the piston is held to be floating by way of the pump pressure; on the one side, the pressure pad is connected with the pressure chamber and, on the other side, it is connected with the suction side of the pump. In this case, the pump delivers in a short-circuit circulation from the delivery side into the pressure pad to the suction side.

In the case of particularly advantageous constructions, it is provided that a controlled pressure regulating valve is provided in the hydraulic circulating system of the revolving door drive. The controlling of the pressure regulating valve may take place in different manners. Preferably, the control takes place by way of the closing spring and/or by way of a separate spring, preferably a spring adapted to the closing spring. During the control by way of the closing spring, the piston travel and the spring prestressing are taken into account. As an alternative, an exclusively travel-dependent control of the valve can be used, in the case of which the piston travel or the rotational angle, for example, of the output/closing shaft or the position of the door is detected. Basically, the control may also take place electronically. As an alternative or in addition, the control may take place by means of a stored program.

In particularly preferred embodiments, it is provided that the pressure regulating valve has a controlled valve pressure chamber. A preferably piston-shaped valve member may be arranged in the valve pressure chamber and cooperates with the spring controlling the pressure regulating valve. A particularly compact arrangement is obtained when the spring controlling the pressure regulating valve is supported with one end on the piston of the piston-cylinder unit and with the other end on the valve member. The spring may advantageously be formed by the closing spring.

Others objects, advantages and novel features of the present invention will become apparent from the following detailed description of the invention when considered in conjunction with the accompanying drawings.

DETAILED DESCRIPTION OF THE DRAWINGS

Figure 1:
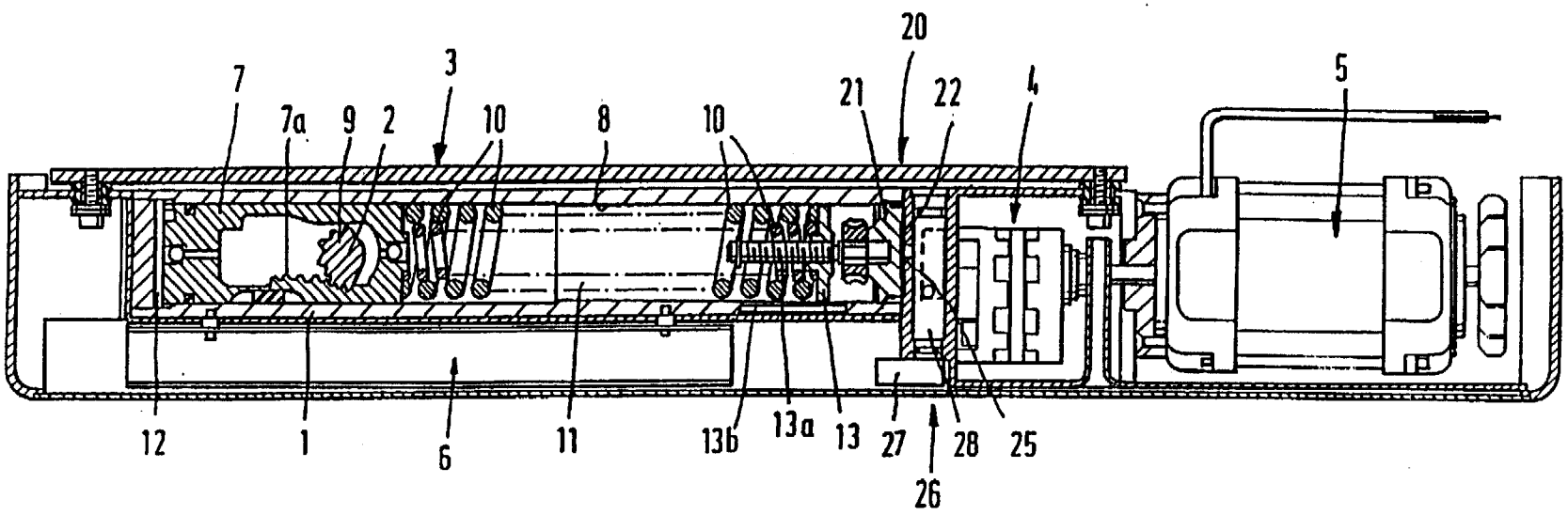
FIG. 1 is a schematic sectional view of a servo-closer according to the invention.

The servo-closers illustrated in the figures are, in each case, a hydraulic revolving door drive by means of which the door is opened by a motor or assisted by a motor and by means of a closing spring is closed in a hydraulically dampened manner. It is constructed as a hydraulically dampened door closer with a closing spring 10, combined with an electrohydraulic opener drive, with an electromotor 5 and a pump 4. The door closer and the opener drive are integrated in a constructional unit in a housing 1.

As in the case of a conventional overhead door closer, the housing 1 may be mounted on the door leaf or the door frame. The output shaft 2 is disposed in the housing 1 corresponding to a conventional closer shaft and can be non-rotatably coupled with a force-transmitting linkage which is not shown. As in the case of a conventional overhead door closer, the linkage is supported on the door frame or on the door leaf.

If the linkage is constructed as a sliding arm, the slider arranged on its free end is guided in a sliding rail arranged on the door frame or on the door leaf. If the linkage is constructed as a shear arm, the free end is disposed in a stationary swivel bearing on the door frame or the door leaf.

In the case of the drive illustrated in the figures, the closer mechanism 3, the hydraulic pump 4 and the electromotor 5 are arranged in the housing 1 next to one another from the left to the right. An electronic control unit 6 is disposed on the frontal side adjacent to the closer mechanism.

The closer mechanism 3 consists of a hydraulic piston 7 guided in a hydraulic cylinder 8. The piston 7 is constructed as a hollow piston and, in its interior, has a rack-shaped toothing 7*a* which meshes with a pinion 9 which is non-rotatably connected with the output shaft 2. The piston 7 interacts with the closing spring 10 which, in the embodiment shown, is arranged in an unpressurized chamber 11 in the hydraulic cylinder on the right of the piston 7. A pressure chamber 12 is constructed on the left side of the piston in the hydraulic cylinder 8. The hydraulic chambers 11 and 12 are hydraulically connected with one another by way of hydraulic ducts.

The sealing surface or sealing edge of the piston 7 is constructed on the left front end of the piston, for example, as a ring surface with a sealing ring 7*a*.

The closing spring 10 is constructed as a compression spring. By means of its left end, it is supported on the right frontal end of the piston 7 and, by means of its right end, it is supported on a spring plate 13. As known from German Patent Document DE-OS 32 24 300, the spring plate 13 can be adjusted by means of an adjusting spindle 13*a* in its axial position in the unpressurized chamber 11, in which case the position of the spring plate 13 and thus the adjustment of the spring force is indicated by means of a magnetic indicating device 13*b* on the outer surface of the housing 1.

By means of its end facing away from the spring plate 13, the adjusting spindle 13*a* engages in a valve member 21 and is disposed in it. The valve member 21 is a component of a pressure regulating valve 20 arranged in the cylinder chamber 8. The closing spring 10 is supported on the valve member 21. The valve member 21 is movably disposed in the hydraulic cylinder 8 and bounds the unpressurized chamber which therefore extends from the right side of the piston 7 to the valve member 21.

Figure 2:
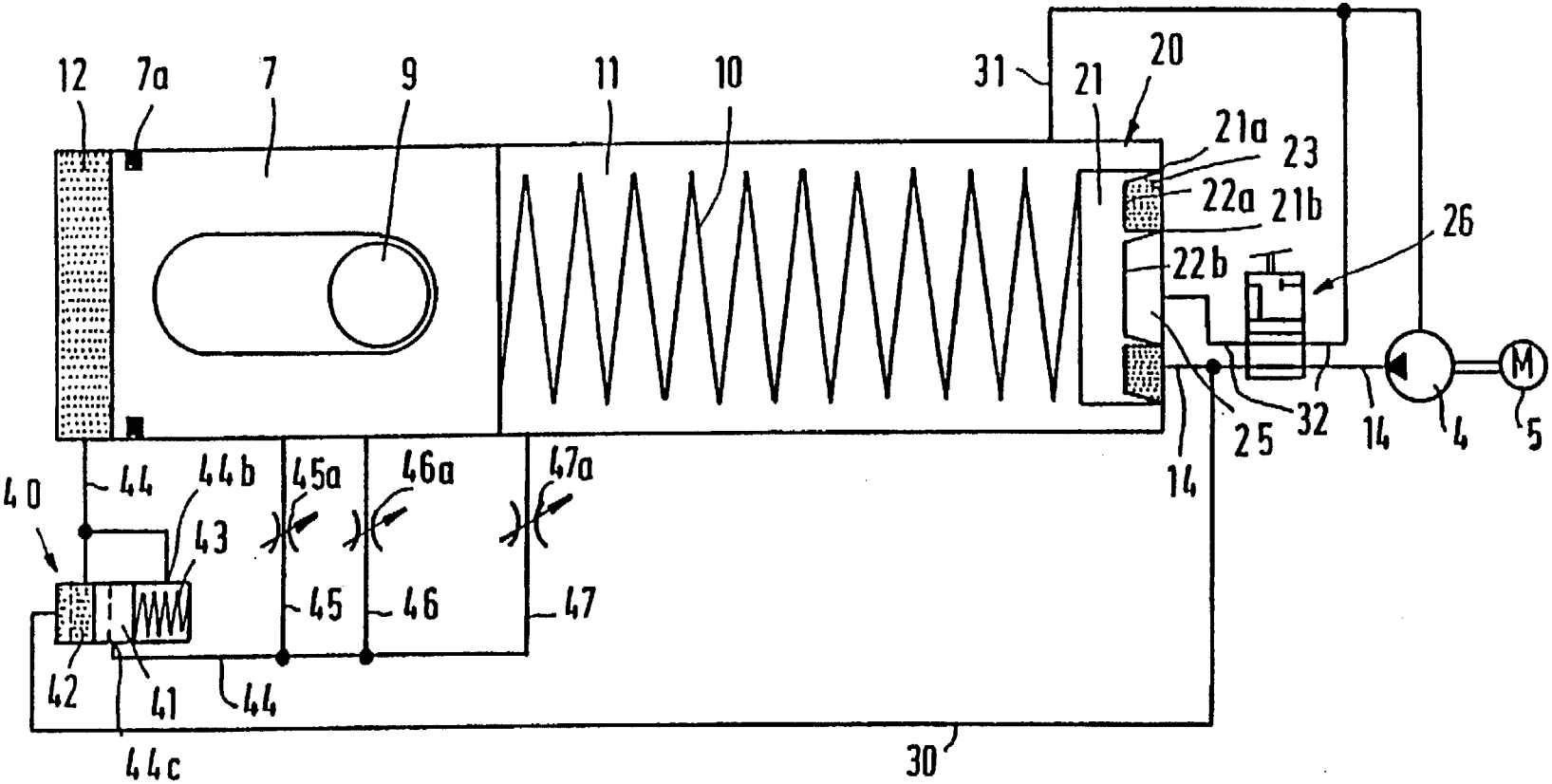
FIG. 2 is a wiring diagram of the servo-closer of FIG. 1.
Figure 3:
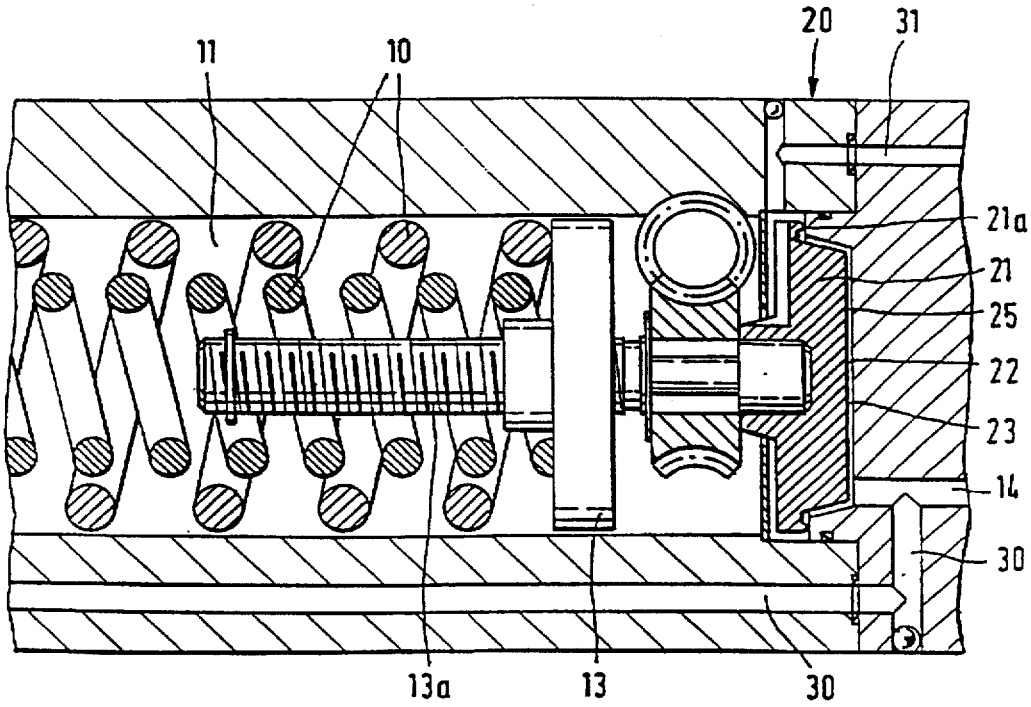
FIG. 3 is an enlarged representation in area III in FIG. 1 with a modified pressure regulating valve.
Figure 4:
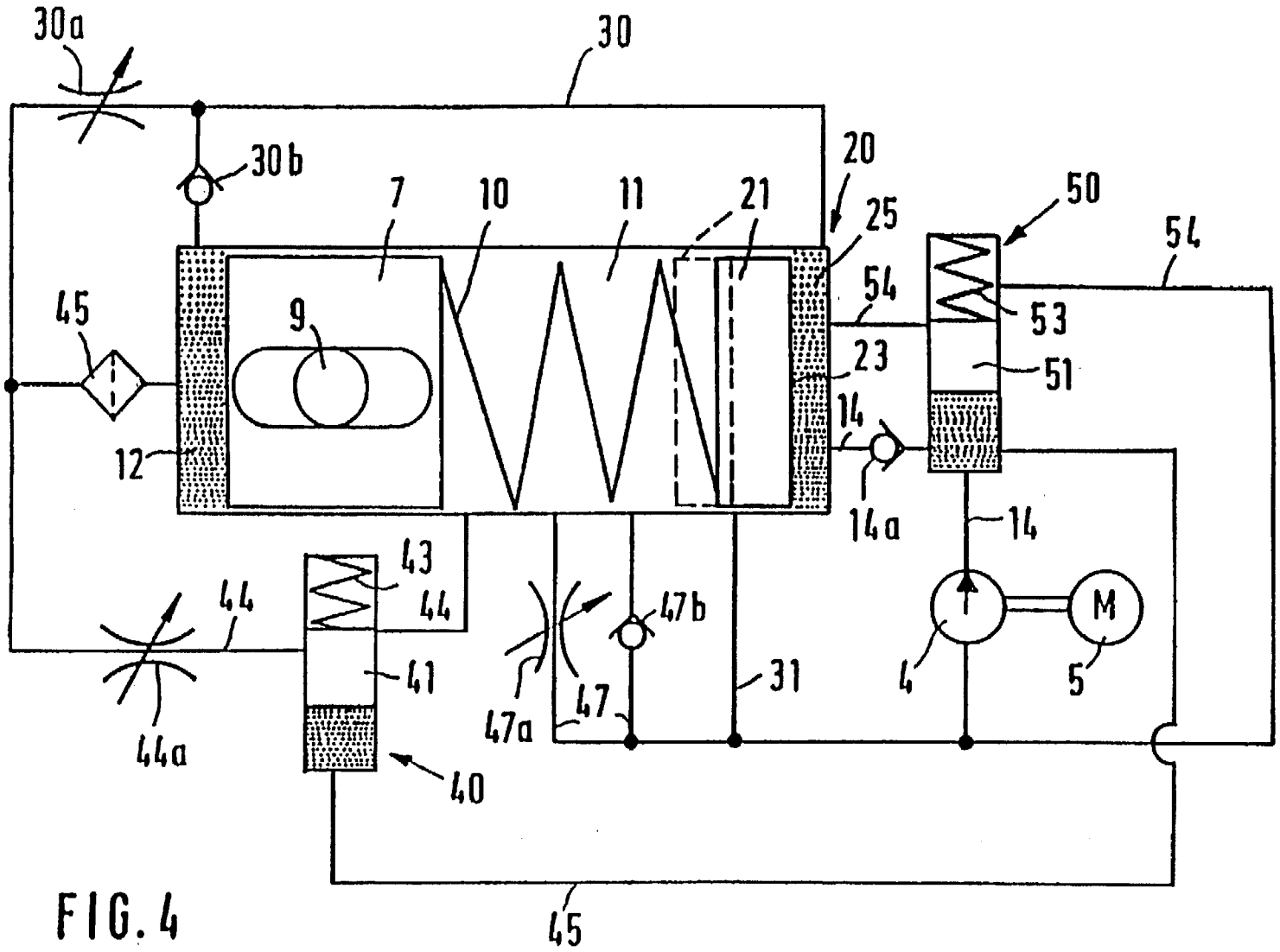
FIG. 4 is a control diagram of another modified embodiment of the servo-closer.

The pressure regulating valve 20 may have different constructions; for example, as a seat valve, of which two variants are illustrated in FIGS. 1, 2 and 3, or as a sliding valve, as illustrated in FIG. 4.

In the case of the seat valves 20 illustrated in FIGS. 2 and 3, the valve member 21 has one or several ring-shaped sealing edges 21*a*, 21*b* which cooperate with a housing-fixed valve seat 23 in that they sit on the valve seat 23 when the valve 20 is closed. A narrowly bounded, minimal valve pressure chamber 25 is formed between the operative valve surface 22 on the valve member 21 and the valve seat 23.

By way of a duct 14, the valve pressure chamber 25 is connected with the delivery side and by way of a duct 31, it is connected with the suction side of the pump 4 (see FIGS. 2 and 3). When the pump is switched on, the valve member 21 is pushed to the left while forming a pressure pad in the valve pressure chamber 25. The hydraulic medium can then flow off into the unpressurized chamber 11 as well as by way of the duct 31 toward the suction side of the pump 4. A pipe 30, which branches off the feeding duct 14 and leads into the pressure chamber 12, is provided as the hydraulic connection of the pressure chamber 12 and the valve pressure chamber 25.

Therefore, the delivery side of the pump 4 is, on the one hand, connected by way of the ducts 14 and 30 with the pressure chamber 12 and, on the other hand, is connected by way of duct 14 with the valve pressure chamber 25. According to the position which the valve member 21 takes up under the effect of the pressure pad, the valve pressure chamber 25 may also be connected directly with the suction side of the pump 4 and with the unpressurized chamber 11, specifically by way of the pipe 31.

In the case of all illustrated constructions of the pressure valve 20, it is important that the pressure chamber 12 of the piston 7 as well as the valve pressure chamber 25 is acted upon by the closing spring 10. Because of the above-described hydraulic connection of the pressure chambers, when the pump 4 is switched on, the same hydraulic pressure occurs in each case in the pressure chamber 12 as well as in the pressure pad in the valve pressure chamber 25. This pressure is a function of the compression of the closing spring 10; that is, it depends on the prestressing of the spring 10 and on its further compression determined by the position of the piston 7. This means that, the higher the prestressing or the strength of the spring 10 and the larger the door opening angle, the larger is the hydraulic pressure occurring in the pressure chambers 12 and 25.

According to the relationship between the operative surface of the piston 7 and the operative valve surface 22—under the effect of the identical hydraulic pressure existing on both sides on the piston 7 and on the closing spring 10—forces act upon the piston 7 which move the piston 7 in a forced manner (automatic opening system) or hold it to be only floating (pure servo function). In the latter case, by way of the pressure pad in the valve chamber 25, the valve member 21 is held to be lifted off the valve seat 23 in such a manner that the pump is short-circuited; that is, the delivery side of the pump is connected with the suction side by way of the pressure pad in the valve pressure chamber 25 and by way of the duct 31, and the pump delivers in this short circulating cycle.

By means of the pressure regulating valve 20, the pressure equilibrium in the pressure chambers 12 and 25 occurs in each case in each opening position of the door in which case, at least when the piston is at rest, the delivery side of the pump is finally connected with the suction side of the pump by way of duct 14, valve pressure chamber 25 and duct 31. In this stationary position, the valve member 21 is slightly lifted off the valve seat 23; in FIGS. 2 and 3, toward the left.

The design of the valve pressure chamber 25 and the size of the operative valve surface depend on the shape of the valve member 21 and of the valve seat 23 and on the position of the sealing edges 21*a*, 21*b*. In FIGS. 2 and 3, the valve member is essentially plate-shaped.

In the case of the construction in FIG. 3, only one sealing edge 21*a* is provided, specifically on the outer edge of the plate-shaped valve member. The surface between this ring-shaped sealing edge 21 which faces the valve seat 23 is the operative valve surface 22 which is in proportion to the operative surface of the piston 7, whereby it is determined whether the drive opens automatically by means of the pump like an automatic drive or only has an assisting effect during the opening.

In the case of the valve used in FIGS. 1 and 2, in contrast to FIG. 3, an optional adjustment of the size of the operative valve surface 22 is possible. For this purpose, a switching valve 26 is disposed fixed to the housing in the feeding duct 14 directly in the valve seat 23. It has a valve body 28 which can be switched by way of a rotary switch 27 and which, in its different positions, has differently acting valve ducts which are assigned to the various effective valve surfaces 22*a*, 22*b* (FIG. 2); that is, that therefore, in the case of one valve position of the switching valve 26, an assigned large valve surface becomes operative and, in the case of another position of the valve 26, an assigned small valve surface 22 becomes operative.

The valve member 21 has an interior and an exterior sealing edge 21*a*, 21*b*. Inside the interior sealing edge 21*b*, a first valve surface 22*b* is situated with a first valve pressure chamber 25*b*, and between the interior and the exterior sealing edge 21*b* and 21*a*, a second valve surface 22*a* is situated with a second valve pressure chamber 25*a*. In one switching position of the switching valve 26, only the first valve pressure chamber 25*a* receives the flow and therefore only the valve surface 22*a* is operative. In the second switching position of the switching valve 26, both valve pressure chambers 25*a* and 25*b* are subjected to the flow and thus the valve surface 22*a* and 22*b*, therefore a larger valve surface, becomes operative.

Figure 5:
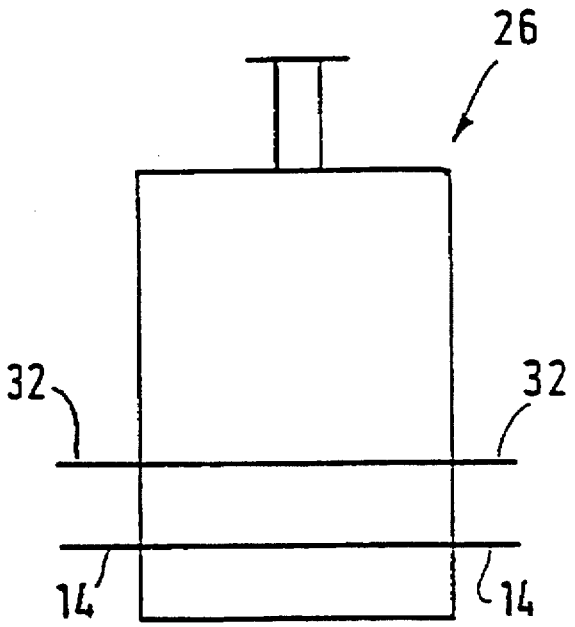
FIG. 5 is a view of a first switching position of the switching valve 26 in FIG. 2.
Figure 6:
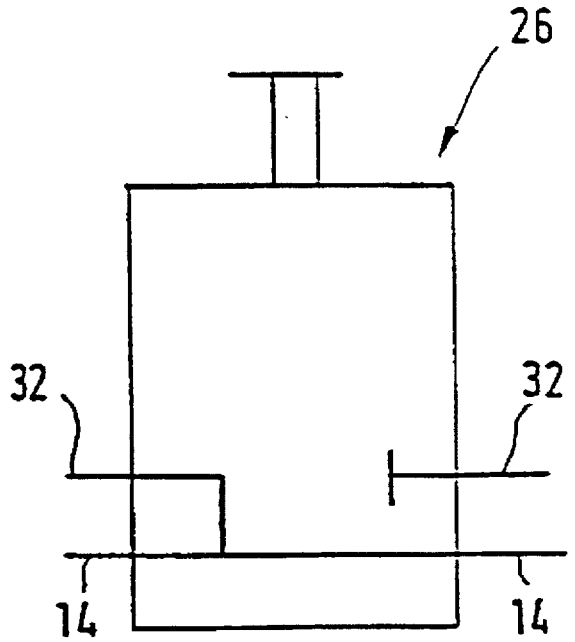
FIG. 6 is a view of a second switching position of the switching valve 26 in FIG. 2.

The two switching positions of the switching valve 26 are illustrated in FIGS. 5 or 6. In the switching position in FIG. 5, which also exists in FIG. 2, the right-hand duct 14 is connected with the left-hand duct 14 and the right-hand duct 32 is connected with the left-hand duct 32. In the other switching position in FIG. 6, the right-hand duct 14 is connected with the left-hand duct 14 and the left-hand duct 32. The right-hand duct 32 is a dead end.

The operative surface of the piston 7 in the pressure chamber 22 is unchangeably constant. With the optional adjustment of the operative valve surface 22 by means of the rotary switch 27, the quotient of the operative surfaces of the valve pressure chamber 25 can therefore be selected. If the quotient of these surfaces is larger than 1, when pressure is admitted by way of the hydraulic pump, a movement of the piston takes place in the opening direction; in the figures, therefore to the right. In this case, the drive therefore acts as an automatic opener drive. If the quotient of the surfaces is equal to 1, the piston is held in a floating manner. This means that, in each piston position, the closing spring 10 is compensated by the hydraulic pressure acting on both sides on the closing spring. The door can therefore be opened without any force like without a door closer. In this case, the drive acts as a pure opening servo drive.

The hydraulic pump 4, which is arranged directly adjacent to the switching valve 26, may be constructed as a conventional geared pump. The electromotor 5 coupled with the hydraulic pump 4 also has a conventional construction.

The switching-on and switching-off of the hydraulic pump 4 takes place by way of one or several sensors. For example, external movement indicators, switches on the door leaf or on the handle or movement indicators in the closer housing and/or a rotation indicator on the closer shaft may be provided for this purpose.

The switch-on operation is initiated by a person who wants to pass through the door, depending on the construction and the arrangement of the sensor either automatically when the person approaches or by a switch operation. The pump will remain switched on until the person has passed through the door which can be sensed by the corresponding sensor or by a time function element.

Subsequently, the pump is switched off or throttled and one or several check valves in return flow pipes leading out of the pressure chamber 12 and the valve pressure chamber 25 open preferably automatically so that the hydraulic medium can flow off from the pressure chambers 12 and 25 into the unpressurized chamber 11 and/or to the suction side of the pump 4.

In this case, while the closing spring 10 is relaxed, the piston 7 is pushed to the left in the figures whereby the pinion coupled with the piston-side toothing is rotated together with the closer shaft 3 clockwise, that is, in the closing direction.

In the embodiment illustrated in FIGS. 1, 2 and 3, the pressure regulating valve 20 controlled by way of the closing spring 10 has two functions. Its first function consists of implementing the control of the pump pressure which is a function of the door opening angle or of the respective closing force, as described above.

The additional second function of the pressure regulating valve 20 consists of the fact that, in the case of an overload; that is, when the door is jammed during the opening or is forced shut during the closing, the pressure regulating valve 20 acts as a safety relief valve. The excessive pressure in the pressure chambers 12 and 25 which in this case built up over a short time—while displacing the valve member 21 to the left and compressing the closing spring 10—is automatically reduced by way of the return flow pipe 31 to the unpressurized side of the hydraulic pump or to the unpressurized chamber 11. Since this control valve 20, which therefore acts as a safety relief valve, is controlled by way of the closing spring 10, the triggering force acting upon the valve rises with the compression of the closing spring 10 so that a constant pressing-open and pressing-closed torque is obtained. This therefore results in a constant response sensitivity of the relief valve irrespective of the opening position of the door, whereby dangers of injury during the use can be reduced.

In the case of the respectively selected surface relationship of the operative valve surface 22 and the operative surface of the piston 7, this function of a safety relief valve is ensured in every case.

The control diagram in FIG. 2 shows the hydraulic circulating system of the servo closer in FIG. 1. In this case, the important operating parts of the servo closer are illustrated schematically as well as the above-mentioned hydraulic ducts: feeding duct 14, connecting duct 30 and return flow duct 31; also the return flow ducts between the pressure chamber 12 and the unpressurized chamber 11 with the throttle valves for adjusting the return flow speed during the closing. These are the ducts 44, 45, 46 and 47 with the throttle valves 45*a*, 46*a* and 47*a* for adjusting the end stop, the closing speed and the closing delay.

As a check valve which prevents the return flow of the hydraulic medium from the pressure chamber 12 during the opening, a hydraulically controlled check valve 40 is provided in the diagram of FIG. 2 which is closed when the door is opened and which is opened when the door is closed. The check valve 40 is arranged in the return flow duct 44 and is controlled by way of the hydraulic pressure in the duct 30. It replaces the solenoid valve which is used in the case of conventional electrohydraulic drives. The illustrated constructions use no solenoid valve.

The check valve 40 is a sliding valve. It shuts off or opens up the return flow duct 44 which connects the pressure chamber 12 with the unpressurized chamber 11. The slide 41 is constructed in a piston shape and is guided in a sealingly slidable manner in a cylindrical valve chamber 42. On its one end face, the slide 41 is acted upon by a valve spring 43 arranged in the valve chamber 42; on its other end face, it is acted upon by the hydraulic pressure of the delivery side of the hydraulic pump 4 by way of the duct 30. During the opening of the door when the pump 4 is switched on, as illustrated by means of a solid line in FIG. 2, the slide 41 is held in the shut-off position under the effect of the hydraulic pressure in which the hydraulic feed pipe is opened up by way of the connection of the ducts 30 and 44 but the return flow duct 44 is shut at 44*c*.

When the hydraulic pressure in the duct 30 is reduced, as in the case of the closing operation when the pump 4 is switched over or switched off or throttled, the slide 41 in the figure is pushed to the left into the position shown by a broken line under the effect of the valve spring 43 and as a result the blocking of the return flow duct 44 is eliminated while 44*b* and 44*c* are connected and the connection of duct 30 and 44 is interrupted.

Instead of or in addition to controlling the closing speed by way of the throttle valves, in the case of modified embodiments, the closing operation, that is, the closing speed may also be regulated by means of the pump. A reversible pump is used for this purpose. During the closing operation, the hydraulic medium is pressed back by way of the pump. The pump will then act as a hydromotor and the electromotor will act as a generator. The closing speed will be controlled electronically.

For this purpose, the current supply takes place by means of the generator itself. In order to control additional closing functions, such as the end stop, the opening damping and the closing delay, microswitches may be mounted in a fixed manner on the closer housing. For this purpose, switches may be arranged at 10 degrees and 80 degrees. By way of the switch at 10 degrees, the closing speed can be controlled separately. The closing delay can also be initiated by way of a time function element. By means of the switch at 80 degrees, the opening damping can be controlled.

By means of the control diagram in FIG. 4, a servo closer is described which has essentially the same construction as the above-described embodiments. However, the pressure regulating valve 20 is constructed as a sliding valve and the hydraulic circulating system is slightly modified. The valve member 21 of the valve 20 is constructed as a piston-shaped slide which is sealingly guided in the cylinder chamber. The valve pressure chamber 25 is constructed in the cylinder chamber on the side of the slide facing away from the closing spring 10.

The feed duct 14 leads out on the frontal side of the valve pressure chamber 25 and the outlet openings of the connecting duct 30 which connects the valve pressure chamber 25 with the pressure chamber 12 are situated there as well as the outlet opening of the return flow duct 54 which can be blocked by a hydraulically controlled check valve 50. The return flow duct 31, which is connected to the suction side of the pump 4, leads out at a distance from the front side of the valve pressure chamber 25 and determines the expansion of the valve pressure chamber 25. Like the seat valves in FIGS. 2 and 3, the sliding valve 20 is used as a pressure regulating valve which, as a function of the momentary closing force, controls the hydraulic pressure with the same pressure in the valve pressure chamber 25 and in the pressure chamber 12, and is used as a safety pressure valve.

During the opening, the piston-shaped slide 21 is in each case under the effect of the pump pressure pushed into the left position which is illustrated by a broken line. The same pressure exists in the pressure chambers 25 and 12 which are connected with the return valve 30*b* by way of the pipe 30. In the left position of the slide 21, the pump 4 leads the hydraulic medium by way of the duct 14 into the pressure chamber 25. The return flow to the suction side takes place by way of the duct 31 from the pressure chamber 25.

During the start of the operation, when the pump is switched on or during a fast opening, the piston-shaped slide 21 is in a position further to the right in which it closes off the outlet opening of the duct 31.

During the closing of the door, when the pump is switched off, the slide 21 is in its right end position. The valve 40 controlled by way of the pump pressure will now be open and therefore the return flow duct 44 will not longer be blocked. Under the effect of the closing spring 10, the piston 7 will now move to the left. In this case, the oil flows by way of the duct 44, the filter 45 and the flow valve 44*a* and the valve 40 into the unpressurized chamber 11. Simultaneously, the return flow takes place into the now unpressurized valve chamber 20 and finally to the suction side of the pump. This return flow from the pressure chamber also takes place by way of the filter 45 and a flow valve 30*a*.

If pressure surges occur during the opening or closing, these are in each case immediately reduced by means of the valve 20 because, under the compression of the closing spring 10, the slide can escape to the left and the hydraulic medium can be drained off by way of the outlet duct 31 and 54.

In the case of the embodiment according to FIG. 4, another function of the valve 20 consists of the fact that it forms a special device for prestoring the energy required for the opening. For this purpose, the pump is switched on before the door is moved and under the effect of the hydraulic medium, the slide is slid to the left into the position indicated by a broken line. In this case, the piston is not moved. As a result, the closing spring 10 is prestressed. Subsequently, the energy from the prestressing is available during the initiating of the opening operation and promotes the opening in the initial phase. Particularly during a fast opening, the slide 21 can be displaced more or less far from the position indicated by a broken line toward the right while, during the opening of the door, the piston 7 is also moved to the right. At least in the initial phase, less force is therefore required during the opening of the door. The energy stored during the prestressing of the closing spring can be used as an opening aid in this manner.

Also in the case of a further opening of the door, by way of a prestressing of the closing spring 10, as a result of the displacement of the slide 21 by way of the hydraulic pump, a force reserve or buffering is obtained which supports the servo effect of the drive during the opening and, for a limited further opening angle, also allows a fast, no-force opening.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. Door drive for a building door, comprising:

a hydraulic piston-cylinder unit with a piston slidably guided in a hydraulic cylinder while forming a pressure chamber for a hydraulic medium and an unpressurized chamber, a door position controlling output shaft drivingly connected with the piston, a closing spring in said unpressurized chamber, said closing spring being operably supported at one end on the piston and at the other opposite end on a movable hydraulic pressure pad, a motor driven opening device with an electric motor driven hydraulic pump for pressurizing the hydraulic medium to operably move the piston, and a control valve assembly for controlling the pressure of the hydraulic medium as a function of a momentary force of the closing spring to thereby control adjustment of the hydraulic medium pressure in the pressure chamber and the pressure on the hydraulic pressure pad.

2. Door drive according to claim 1, wherein the pressure chamber and the hydraulic pressure pad are hydraulically connected with a delivery side of the hydraulic pump, and wherein adjusting means are provided for adjusting a pressure equilibrium in the pressure chamber and in the pressure pad so that the hydraulic pump is operated with respective ones of (i) running without further displacement work, (ii) being short-circuited and holding the piston in a floating manner, and (iii) carrying out displacement work and moving the piston.

3. Door drive according to claim 1, wherein the control valve assembly includes a controlled pressure regulating valve provided in a hydraulic circulating system of the door drive.

4. Door drive according to claim 3, wherein the pressure regulating valve is controlled by one of the closing spring and a separate spring coordinated with the closing spring.

5. Door drive according to claim 4, wherein the pressure regulating valve has a controlled valve pressure chamber.

6. Door drive according to claim 4, wherein the pressure pad is connected with the pressure regulating valve and forms a controlled valve pressure chamber of the pressure regulating valve.

7. Door drive according to claim 6, wherein the valve pressure chamber has a controllable outlet duct which is connected with a suction side of the hydraulic pump.

8. Door drive according to claim 7, wherein a valve member is arranged in the valve pressure chamber and cooperates with the closing spring controlling the pressure regulating valve.

9. Door drive according to claim 3, wherein the pressure regulating valve has a controlled valve pressure chamber.

10. Door drive according to claim 9, wherein the pressure pad is connected with the pressure regulating valve and forms a controlled valve pressure chamber of the pressure regulating valve.

11. Door drive according to claim 9, wherein the valve pressure chamber has a controllable outlet duct which is connected with a suction side of the hydraulic pump.

12. Door drive according to claim 9, wherein a valve member is arranged in the valve pressure chamber and cooperates with the closing spring controlling the pressure regulating valve.

13. Door drive according to claim 12, wherein the closing spring is a compression spring supported with one end on the piston of the piston-cylinder unit and with its other end on a spring plate operable connected with the pressure pad.

14. Door drive according to claim 13, wherein the valve member acts upon an outlet duct connected to the hydraulic pressure pad.

15. Door drive according to claim 13 comprising a switch for adjusting the relationship of the operative valve surface of the valve member and of the operative surface of the piston of the piston-cylinder unit.

16. Door drive according to claim 12, wherein the valve member acts upon an outlet duct connected to the hydraulic pressure pad.

17. Door drive according to claim 16, comprising a switch for adjusting the size of the operative valve surface of the valve member.

18. Door drive according to claim 17, comprising a switch for adjusting the relationship of the operative valve surface of the valve member and of the operative surface of the piston of the piston-cylinder unit.

19. Door drive according to claim 12, comprising a switch for adjusting the size of the operative valve surface of the valve member.

20. Door drive according to claim 19, wherein the switch is a manual switch which cooperates with the operative valve surface of the pressure regulating valve.

21. Door drive according to claim 12, comprising a switch for adjusting the relationship of the operative valve surface of the valve member and of the operative surface of the piston of the piston-cylinder unit.

22. Door drive according to claim 21, wherein the switch is a manual switch which cooperates with the operative valve surface of the pressure regulating valve.

23. Door drive according to claim 3, wherein the pressure regulating valve is constructed as a slide valve with a piston-shaped valve member.

* * * * *